US007096650B2

(12) United States Patent
Van Dam

(10) Patent No.: US 7,096,650 B2
(45) Date of Patent: Aug. 29, 2006

(54) DEVICE FOR FILLING A CARTON

(75) Inventor: Aaldert Christiaan Van Dam, Silver City, NV (US)

(73) Assignee: BluePrint Holding B.V., Woerden (NL)

( * ) Notice: Subject to any disclaimer, the term of this patent is extended or adjusted under 35 U.S.C. 154(b) by 1 day.

(21) Appl. No.: 10/954,297

(22) Filed: Oct. 1, 2004

(65) Prior Publication Data

US 2006/0070353 A1 Apr. 6, 2006

(51) Int. Cl.
*B65B 35/50* (2006.01)
*B65B 5/06* (2006.01)

(52) U.S. Cl. ..... 53/540; 53/201; 53/247

(58) Field of Classification Search ..... 53/201, 53/540

See application file for complete search history.

(56) References Cited

U.S. PATENT DOCUMENTS

| | | | | |
|---|---|---|---|---|
| 2,896,384 A | | 7/1959 | Carlsen et al. | |
| 2,941,339 A | * | 6/1960 | Salwasser | 53/447 |
| 3,040,491 A | * | 6/1962 | Viitanen | 53/443 |
| 3,323,283 A | | 6/1967 | Johnson, Jr. et al. | |
| 3,479,795 A | | 11/1969 | Russell | |
| 4,492,070 A | | 1/1985 | Morse et al. | |
| 4,583,351 A | | 4/1986 | Fallas et al. | |
| 4,660,352 A | | 4/1987 | Deines et al. | |
| 4,864,801 A | | 9/1989 | Fallas et al. | |
| 4,942,720 A | * | 7/1990 | Berney | 53/447 |
| 5,117,614 A | * | 6/1992 | Johnsen | 53/540 |
| 5,675,963 A | * | 10/1997 | Nicholson et al. | 53/540 |
| 5,778,640 A | | 7/1998 | Prakken et al. | |
| 6,574,943 B1 | * | 6/2003 | Van Dam | 53/447 |
| 2003/0033788 A1 | | 2/2003 | Van Dam | |

* cited by examiner

*Primary Examiner*—John Sipos
(74) *Attorney, Agent, or Firm*—Young & Thompson

(57) ABSTRACT

Device and method for filling a carton with flexible articles. Individual articles are grouped to a vertical stack and entered in a cassette in which the stack is tightly received. The cassette is closed on all sides and after removing of the opening the stack of bags will gently drop in a carton being positioned below.

According to a further aspect of the invention the device is arranged to provide both horizontal and vertical stacking of bags in cartons by replacing the cassette by a carton which is subsequently tilted.

8 Claims, 8 Drawing Sheets

DEVICE FOR FILLING A CARTON

The invention relates to a device for filling a carton with flexible articles such as bags. More particular the subject application is directed to filling a carton with relatively heavy bags such as bags filled with French fries and having a weight of one or more kilograms. However it should be understood hat the invention is not limited to such bags.

Handling of the bags should be effected with high speed whilst at the same time damaging of the product should be prevented as much as possible. Damage to products is a problem if the products are relatively fragile due to either a low temperature or the nature thereof (chips).

BACKGROUND OF THE INVENTION

U.S. Pat. No. 6,574,943 in the name of Allard A. C. Van Dam assigned to Blue Print Holding B.V. in Woerden discloses a device wherein the bags are substantially horizontally fed to a stacker in which they are grouped as vertical stack. After a group of articles has been gathered this group is pushed sidewards in the opening of a tilted carton. After the carton is placed in its position of shipment the bags are in vertical position.

It is an object of the present invention to provide in a device for filling of cartons wherein the bags can be positioned in horizontal position in the position of shipment of the carton.

It is a further aim of the invention to provide a device for filling of cartons in which the bags can be both horizontally and vertically be entered in a carton.

SUMMARY OF THE INVENTION

According to one aspect the subject invention relates to a device for filling a carton with flexible articles such as bags, comprising a substantially horizontal feeding conveyor for articles, a stacker at the discharge end of said feeding conveyor for receiving and collecting said articles on top of each other, a cassette having side walls and a bottom wall, transfer means between said stacker and said cassette to transfer a group of articles formed from said stacker in said cassette, a carton receiving station below said cassette, said bottom of said cassette being removable from said container to allow said groups of articles to drop into said carton receiving station.

According to a further aspect of the invention a device is proposed having a substantially horizontal feeding conveyor for articles, a stacker at the discharge end of said feeding conveyor for receiving and collecting said articles on top of each other, a carton receiving station downstream from said stacker, transferral means acting between said stacker and said carton receiving station wherein said carton receiving station is displaceable arranged between a horizontal position below said cassettes and a vertical position in front of said transferral means.

According to yet a further aspect the invention relates to a method for filling a carton with flexible articles such as bags, comprising substantially horizontal feeding of said bags to a buffer, depositing said articles on top of each other in said buffer in order to provide a vertical stack of articles, displacing said vertical stack of articles in an enclosure having a shape substantially corresponding to the shape of said group of articles, said enclosure delimiting said groups of articles on all sides, removing the bottom of said enclosure and allowing said group of articles to drop from said enclosure into a carton being positioned there below.

BRIEF DESCRIPTION OF THE DRAWINGS

An exemplary embodiment of the invention, which should in no way be interpreted as limiting, is shown in the drawing, wherein.

The device according to the invention is general referred to by 1. It comprises a main frame 3 in which a substantially horizontal conveyor 2 is provided. The person skilled in the art will immediately understand that the conveyor 2 might slightly be slanted relative to the horizontal and can comprise any conveyor suitable for conveying articles 10 such as bags of French fries.

Figure 1:
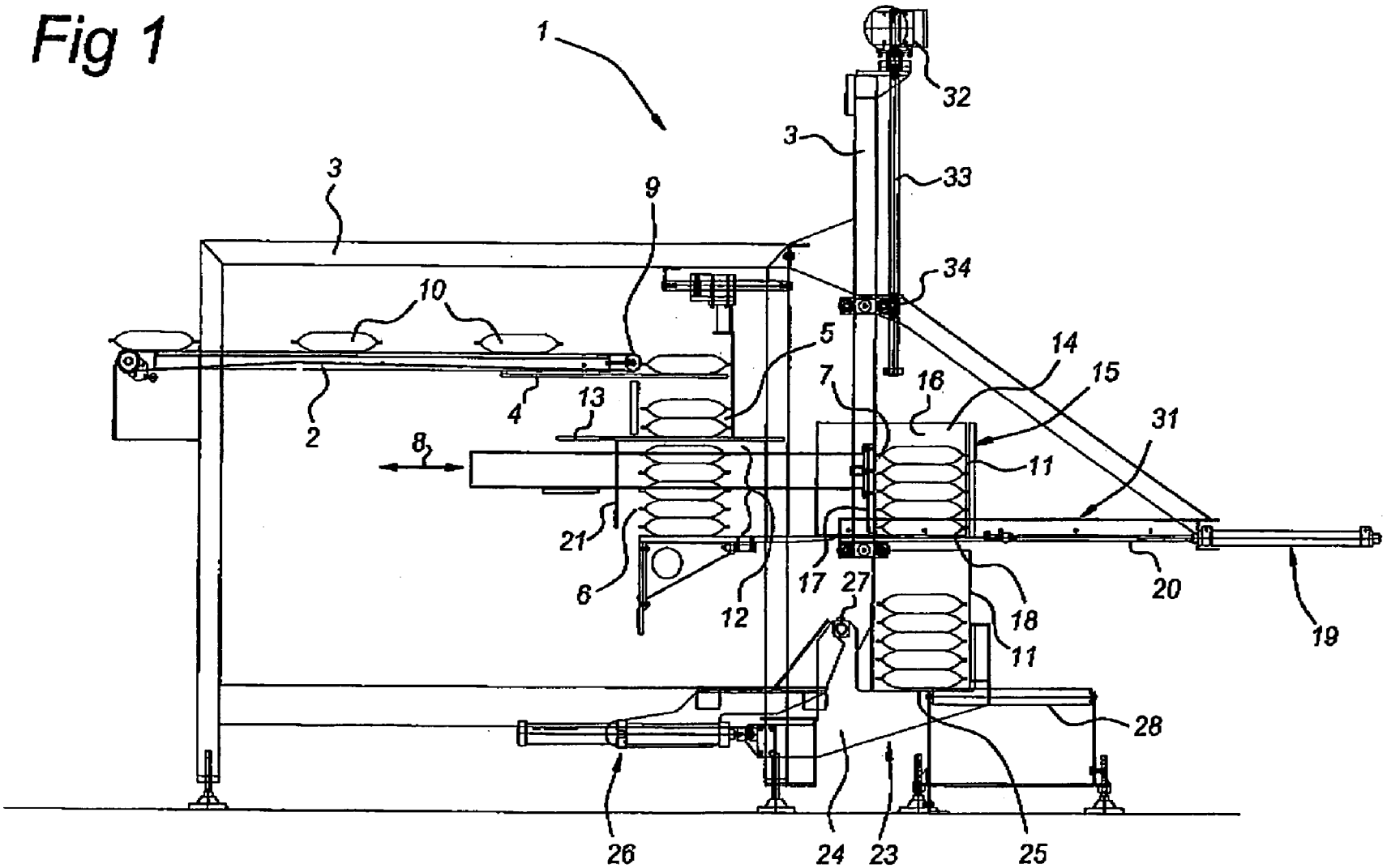
FIG. 1 schematically shows the device according to the invention at the first step during horizontal stacking of bags in a carton.

The discharge end of conveyor 2 is indicated by 9 where a reciprocating support 4 is provided. Bags are delivered on support 4 and drop by sliding support 4 to the left (FIG. 1). An auxiliary buffer space 5 is provided in order to accumulate (store) enough bags 10 to buffer the time that is required to complete the pusher 21 cycle in the main buffer space 6. Main buffer space 6 and auxiliary buffer space 5 are separated by buffer plate 13. This buffer plate 13 can also be moved to the left to allow the stored (buffered) bags in buffer space 5 to be deposited onto lift plate 99. Lift plate 99 is close under buffer plate 13 when buffer plate 13 pulls to the left. After that the lift plate steps down a distance that corresponds with the thickness of the bags for every bag that comes down from carrier plate 4 until a complete carton load 12 (5 articles in this example) is stacked on top of the lift plate 99. A pusher 6 is provided being in FIG. 1 on the left side of group 12 of articles.

Figure 2:
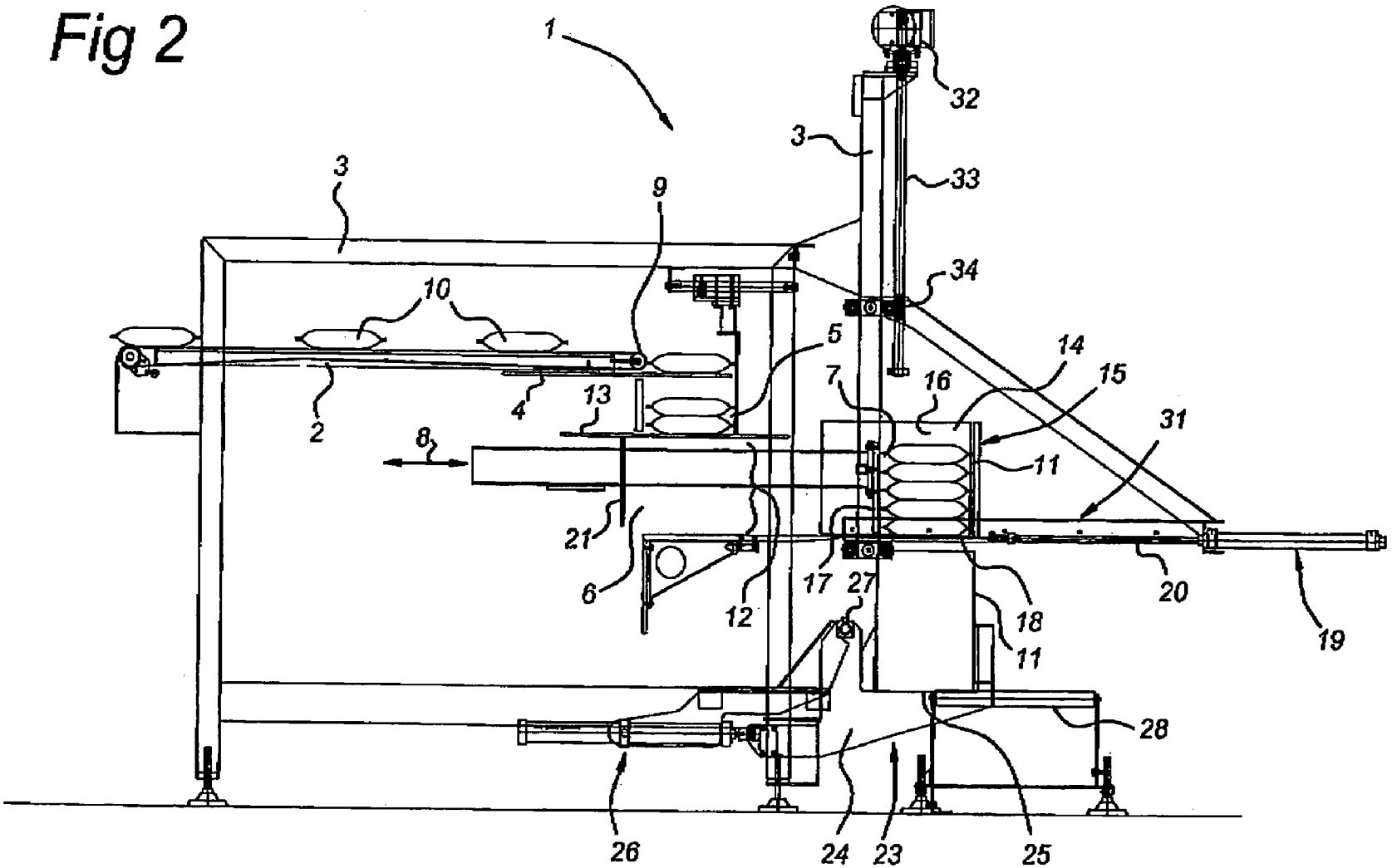
FIG. 2 shows the device according to FIG. 1 during a second step.

The pusher 6 can be moved in the direction of arrow 8 and by actuating the cylinder 7 in FIG. 1 from the right to the left the situation of FIG. 2 is effected.

Figure 3:
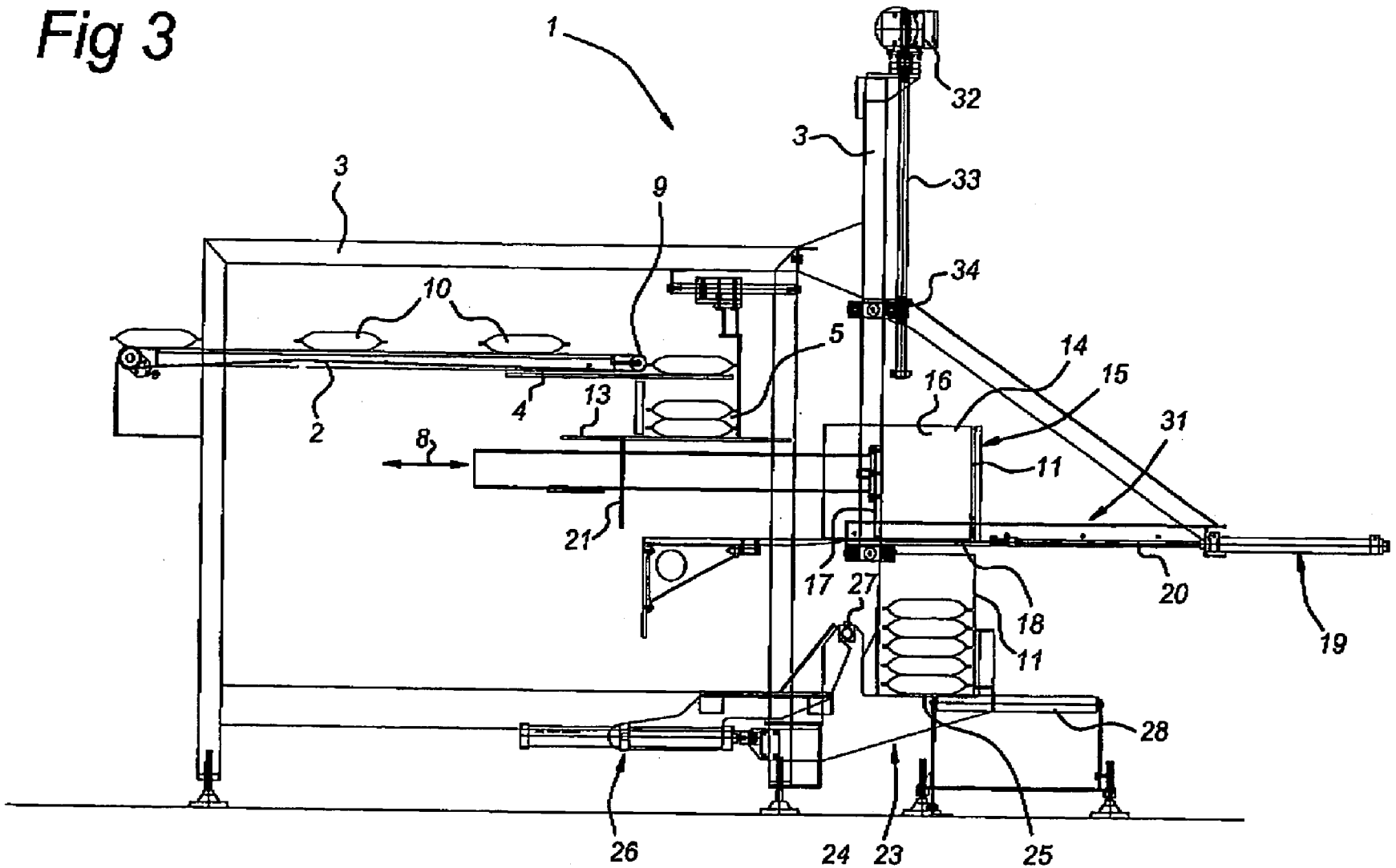
FIG. 3 shows the device according to FIG. 1 and 2 in a third step.

A cassette 15 is provided having three circumferential sidewalls 16 and an open front 17. The top of the cassette is indicated by 14 whilst the bottom thereof has reference 18 and is realised as a slide. By transferring group 12 of articles to the right by pusher 7, the pusher plate 21 will close the last open side of the cassette 15. This is shown in FIG. 2. By subsequently displacing the slide 18 through operation of rod 20 of cylinder 19 to open the cassette the group of articles will drop in a carton 11 being provided on platform 25 of the carton receiving station 23 (see FIG. 3). Because the carton load 12 of articles fits relatively tightly into carton 11 some over pressure will be generated under the articles 12 during the drop inside the carton. This over pressure in the carton under the articles reduces the speed of the articles during dropping in carton 11. This speed reduction (cushioning) reduces damage to the articles whilst this action is sufficiently fast to allow for a high feed of articles 10 on conveyor 2 on the other hand.

Box 11 is subsequently discharged to discharge conveyor 28.

In this way horizontal stacking of bags (horizontal in the position of opening of the box) can be realised in an efficient way with a high speed.

As shown in the figures platform 25 is tiltable around pivot 27. Tilting is effected by cylinder 26. Cassette 15 is provided on an auxiliary frame 31 which can be moved upward and downwardly through a motor 32 having a spindle 33 engaging in a nut like structure 34 being connected to frame 31.

Figure 5:
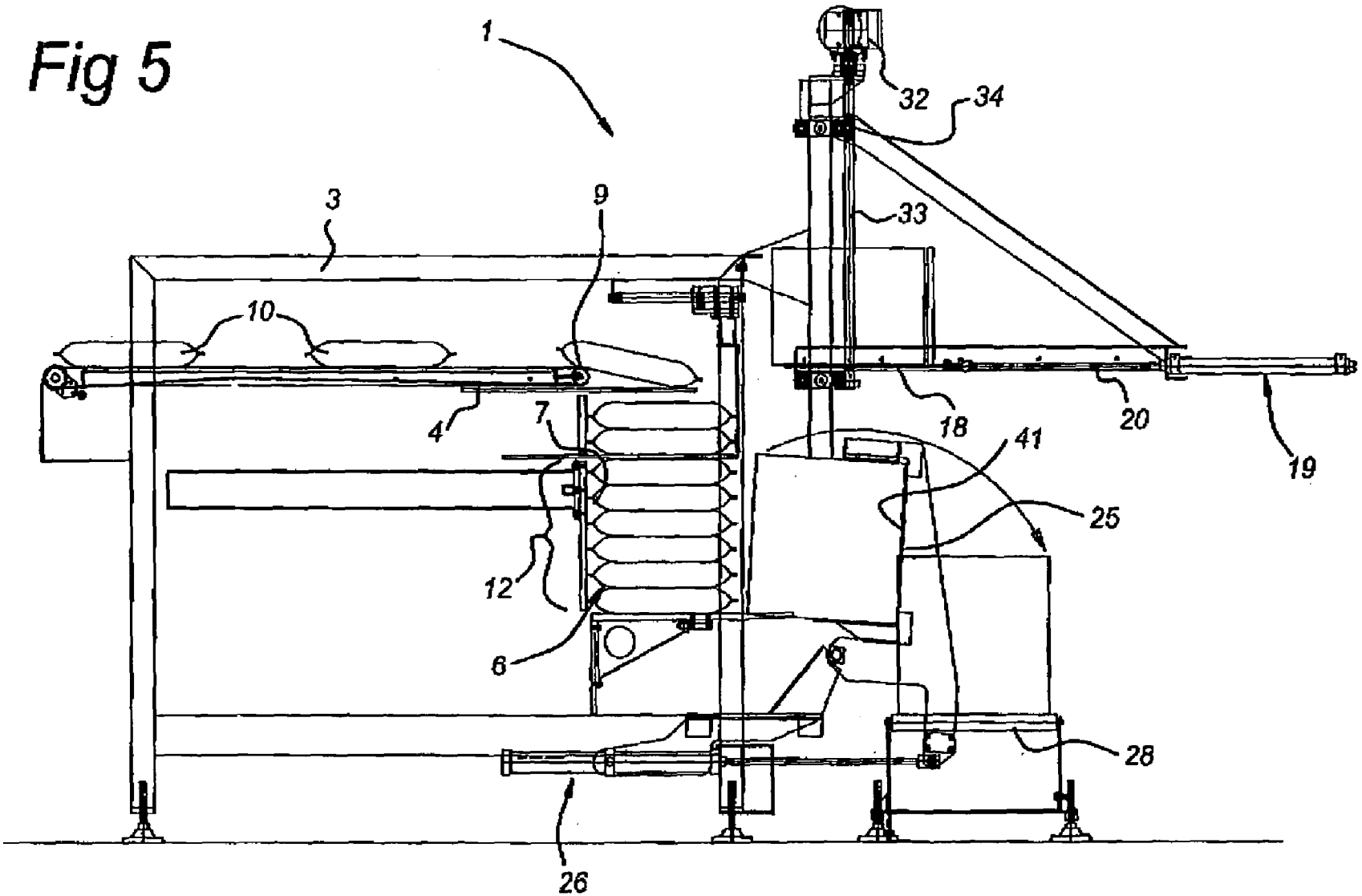
FIG. 5 shows the device according to the invention during vertical stacking in a first step.

The effect of both tilting the platform 23 and moving cassette 15 in upward direction is shown in FIG. 5 and on. In this figure it is shown that the cassette together with slide 18 is moved to an inoperative position. Cylinder 26 has been operated such that a carton receiving platform 25 is in a vertical position with the supporting platform thereof which means that carton 41 has its opening laterally.

Figure 6:
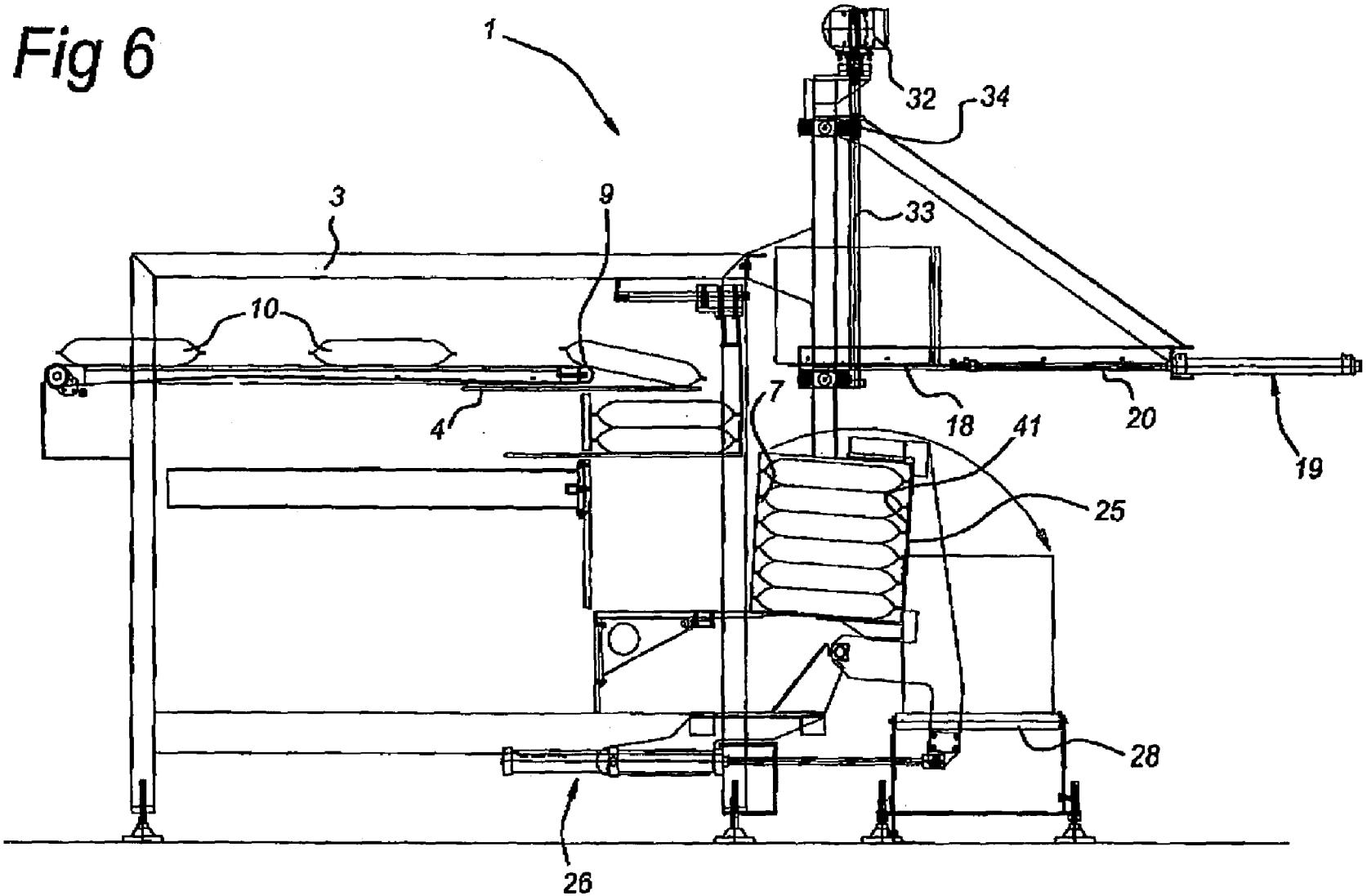
FIG. 6 shows the device according to FIG. 5 during a second step.
Figure 7:
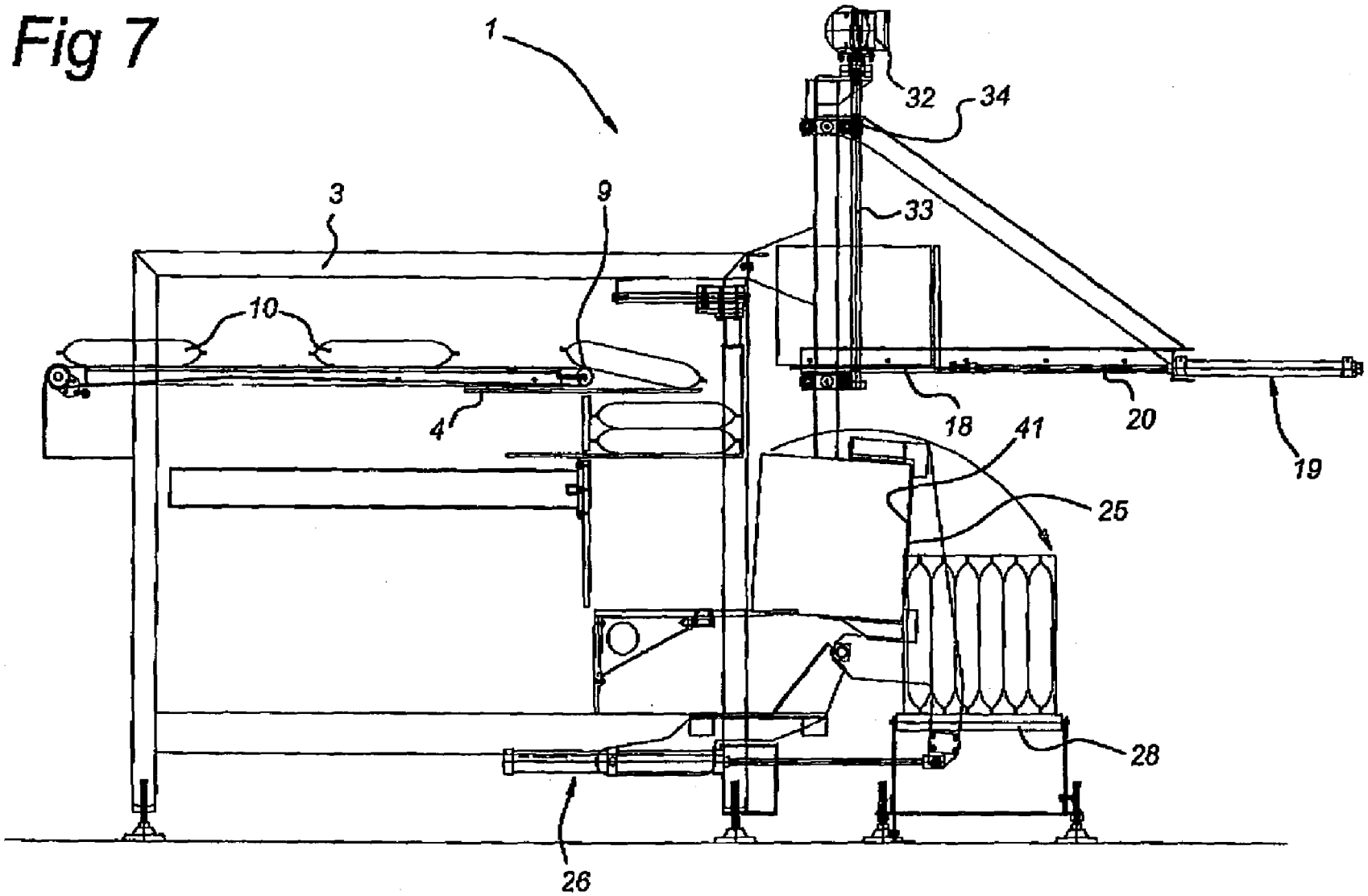
FIG. 7 shows the device according to FIG. 5 in a third step.

According to the invention in this position of operation, in the same way as described above, a group of articles 12 (complete carton load) is positioned in main buffer space 6 supported by lift plate 99 and possibly compressed under buffer plate 13. Subsequently pusher 7 is activated. This is shown in FIG. 5. From FIG. 6 it is clear that the articles are not entered into a cassette but directly into carton 41. After filling carton 41 by operating pusher 7, cylinder 26 is operated to bring the platform 25 in substantially horizontal position for discharge to discharge conveyor 28. In this way articles 10 are stacked vertically adjacent to each other in the position of opening of the carton.

Figure 4:
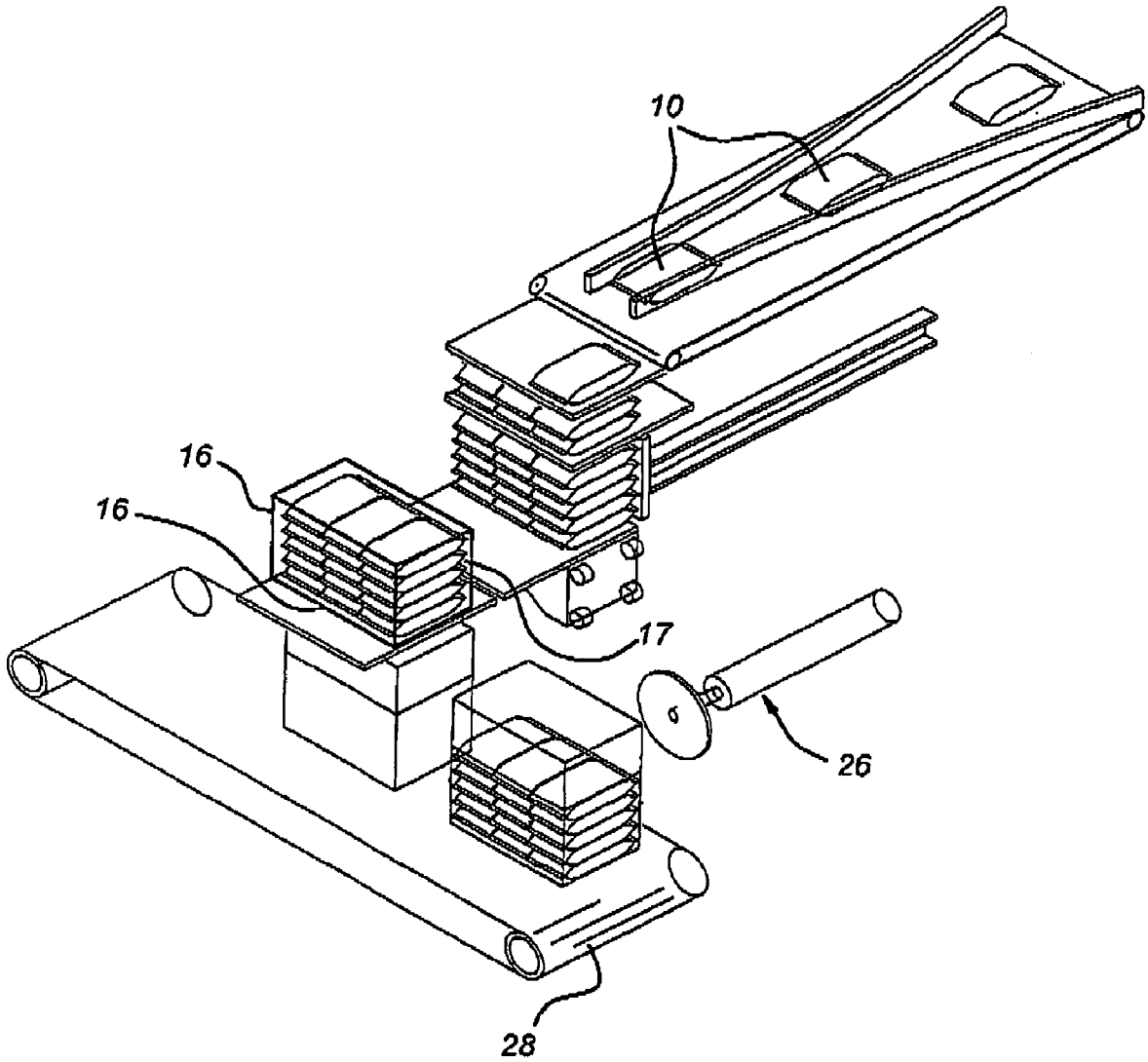
FIG. 4 shows the device according to FIGS. 1–3 in perspective.
Figure 8:
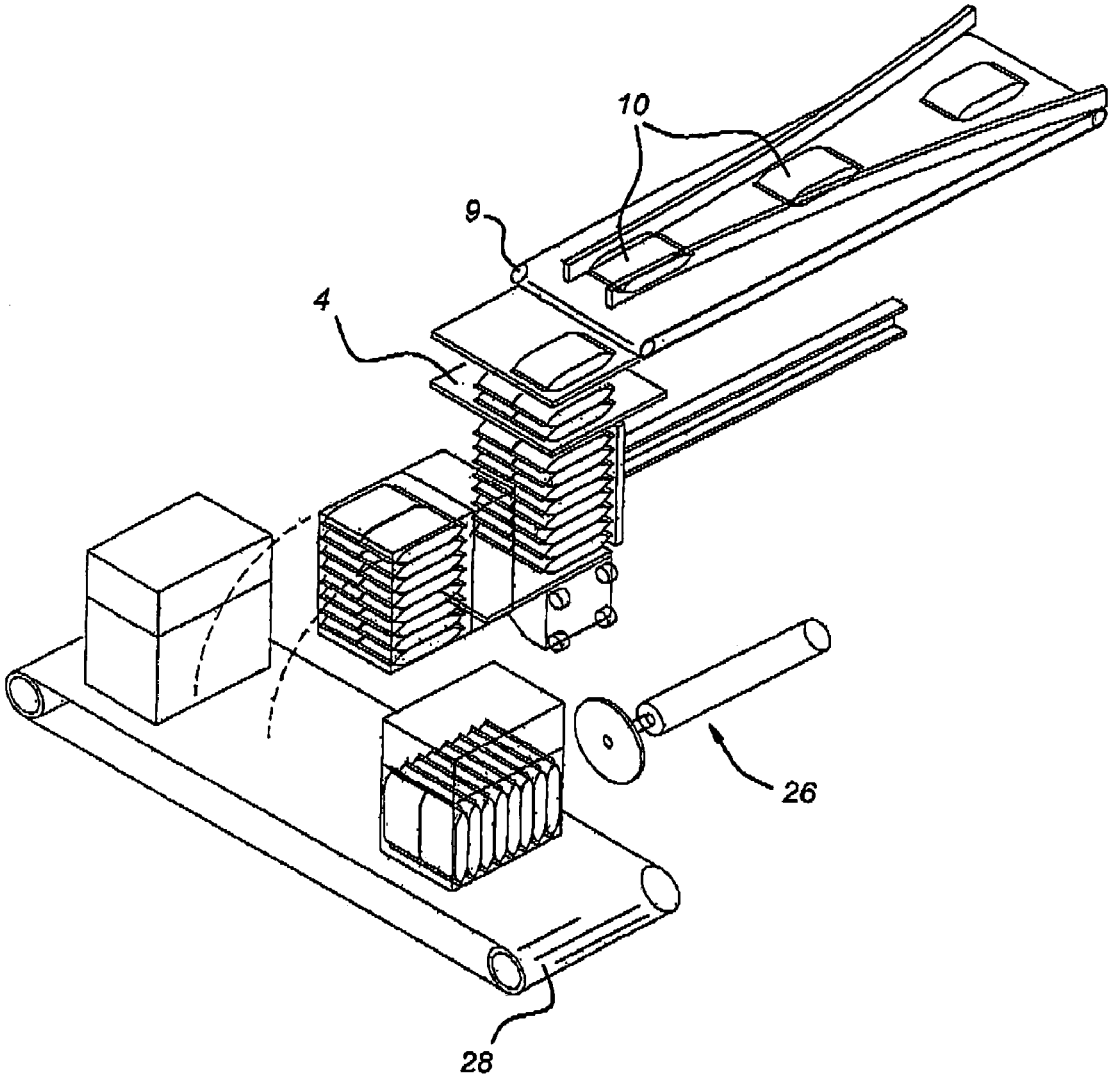
FIG. 8 shows the device according to FIGS. 5–7 in perspective.

Depending on the requirements of the user of the cartons it is simply possible in the way as described above to quickly change from horizontal to vertical stacking and vice versa in a carton for the same product. It should be understood that it is possible in vertical and horizontal packing to have more than one article 10 per stacked layer in the main buffer space 6 as shown in FIGS. 4 and 8 respectively. The stacked layers of multiple bags are created by a lane divider 100 that is placed on top of the horizontal feed conveyor. The lane conveyor comprises of two flexible vertical side guides as shown in FIGS. 4 and 8. These side guides move from side to side to allow the bags 10 to exit in different positions (lanes).

It will be understood that only examples are given above and that the invention is by no means limited thereto. Variants will immediately occur to the person skilled in the art on reading the above description and I was in the scope of the dependent claims.

The invention claimed is:

1. A device for filling a carton with flexible articles, comprising a substantially horizontal feeding conveyor for articles, a stacker at the discharge end of said feeding conveyor for receiving and collecting said articles on top of each other, a cassette having side walls and a bottom wall, transfer means between said stacker and said cassette to transfer a group of articles formed from said stacker into said cassette, a carton receiving station below said cassette, said bottom of said cassette being removable from said cassette to allow said groups of articles to drop into said carton receiving station, said cassette being displaceably arranged between an operative position in front of said transfer means and an inoperative position above said transfer means and wherein said carton receiving station is displaceable between a horizontal position below said cassettes and a vertical position in front of said transfer means.

2. The device according to claim 1, wherein said transfer means comprise horizontally acting displacement means and wherein said cassette has an open side for receiving said articles therethrough.

3. The device according to claim 2, wherein said displacement means comprise a pusher arranged to provide a side of said container.

4. The device according to claim 1, wherein said bottom wall of said cassette comprises a slide.

5. The device according to claim 1, wherein said cassette is displaceable between a horizontal position below said transfer means and a vertical position in front of said transfer means.

6. The device according to claim 1, wherein said cassette and said carton receiving station are provided on an auxiliary frame connectable to a main frame of said conveyor.

7. The device according to claim 1, wherein the transfer means comprise a horizontally acting displacement means.

8. The device according to claim 7, wherein said displacement means comprises a pusher plate.

* * * * *